US008033090B2

(12) United States Patent
Birlem

(10) Patent No.: US 8,033,090 B2
(45) Date of Patent: Oct. 11, 2011

(54) METHOD FOR THE BIDIRECTIONAL TRANSMISSION OF DATA BETWEEN ONE OR MORE TEXTILE MACHINES

(75) Inventor: Olav Birlem, Erkelenz (DE)

(73) Assignee: Oerlikon Textile GmbH & Co. KG, Monchengladbach (DE)

( * ) Notice: Subject to any disclaimer, the term of this patent is extended or adjusted under 35 U.S.C. 154(b) by 710 days.

(21) Appl. No.: 12/083,419

(22) PCT Filed: Sep. 30, 2006

(86) PCT No.: PCT/EP2006/009521

§ 371 (c)(1),
(2), (4) Date: Apr. 11, 2008

(87) PCT Pub. No.: WO2007/045346

PCT Pub. Date: Apr. 26, 2007

(65) Prior Publication Data

US 2009/0225634 A1 Sep. 10, 2009

(30) Foreign Application Priority Data

Oct. 19, 2005 (DE) ..... 10 2005 050 058

(51) Int. Cl.
*D01H 13/32* (2006.01)

(52) U.S. Cl. ..... 57/265; 57/264

(58) Field of Classification Search ..... 57/264, 57/265

See application file for complete search history.

(56) References Cited

U.S. PATENT DOCUMENTS

| | | | | |
|---|---|---|---|---|
| 4,984,749 | A | 1/1991 | Matsui et al. | 242/35.5 R |
| 5,224,047 | A | 6/1993 | Kitagawa et al. | 364/470 |
| 5,676,329 | A * | 10/1997 | Bertoli et al. | 242/413.9 |
| 6,381,511 | B1 * | 4/2002 | Hermanns et al. | 700/139 |

FOREIGN PATENT DOCUMENTS

| | | | |
|---|---|---|---|
| DE | 39 14865 | A1 | 11/1989 |
| DE | 38 41 464 | A1 | 6/1990 |
| DE | 40 31 419 | A1 | 4/1991 |
| DE | 41 37 742 | A1 | 5/1992 |
| DE | 43 40 394 | A1 | 10/1994 |
| DE | 100 39 093 | A1 | 3/2001 |
| DE | 100 55 026 | A1 | 5/2002 |
| EP | 1 300 358 | A2 | 4/2003 |
| GB | 2 368 853 | A | 5/2002 |

* cited by examiner

*Primary Examiner* — Shaun R Hurley
(74) *Attorney, Agent, or Firm* — K & L Gates LLP

(57) ABSTRACT

Method for the bidirectional transmission of data between one or more textile machines (1) producing cross-wound bobbins and/or one or more same-level and/or higher level control systems with a device (2) for transmitting data to a transport medium, which is used for the transporting of data located on the transport medium, the transport medium being in operative connection with the textile machine (1) producing cross-wound bobbins to transmit data via the device (2). According to the invention, a memory, a hard disc, a magnetic tape, a writable compact disc (CD), a writable digital versatile disc (DVD), a magneto-optical disc (MO disc), a minidisc (MD) or a digital memory card provided in a mobile telephone or a palm-top computer (personal digital assistant) are used as the transporting medium and the device (2) is integrated in an exchangeable manner in the textile machine (1).

14 Claims, 1 Drawing Sheet

METHOD FOR THE BIDIRECTIONAL TRANSMISSION OF DATA BETWEEN ONE OR MORE TEXTILE MACHINES

CROSS-REFERENCES TO RELATED APPLICATIONS

This application claims the benefit of German patent application 10 2005 056 058.7, filed Oct. 19, 2005, herein incorporated by reference.

BACKGROUND OF THE INVENTION

The present invention relates to a method for the bidirectional transmission of data between one or more textile machines. More particularly, the present invention relates to such a method for the bidirectional transmission of data between one or more textile machines producing cross-wound bobbins and/or one or more same-level and/or higher level control systems with a device for transmitting data to a transport medium, which is used for the transporting of data located on the transport medium, the transport medium being in operative connection with the textile machine producing cross-wound bobbins to transmit data via the device.

It is known from German Patent Publication DE 100 55 026 A1, for the bidirectional transmission of data between textile machines, to connect them to one another and to a central control system by means of a network. For this purpose, corresponding cabling and apparatus equipment corresponding to the network architecture, for example Ethernet, Token Ring or Fibre Distributed Data Interface (FDDI) are required to be able to build up networks of this type. As an alternative to cabling, the network architecture may also be implemented in a wireless manner, in other words as a so-called wireless local area network (WLAN). The indispensable prerequisite for data exchange between the textile machines and/or the central control system is an existing network infrastructure, the structure, maintenance and upkeep of which do not give rise to unreasonable costs.

A further possibility for data transmission is to connect a notebook to the respective textile machine to be able to transfer data from the latter to the notebook and vice versa. As notebooks are relatively expensive, react extremely sensitively to unusual mechanical stresses, such as a fall, and the use of a notebook and its connection to the textile machine is a relatively complex process, the use of notebooks across the board for transporting data can only be implemented with a large financial outlay.

SUMMARY OF THE INVENTION

It is therefore the object of the present invention to provide a method for transmitting data from a textile machine producing cross-wound bobbins to a transport medium, which allows the use of transport media which are economical and substantially insensitive in terms of disruption with respect to external influences.

This is achieved according to the invention an improved method for the bidirectional transmission of data between one or more textile machines producing cross-wound bobbins and/or one or more same-level and/or higher level control systems with a device for transmitting data to a transport medium, which is used for the transporting of data located on the transport medium, the transport medium being in operative connection with the textile machine producing cross-wound bobbins to transmit data via the device. According to the invention, a memory, a hard disc, a magnetic tape, a writable compact disc (CD), a writable digital versatile disc (DVD), a magneto-optical disc (MO disc), a minidisc (MD) or a digital memory card provided in a mobile telephone or a palm-top computer (personal digital assistant) are used as the transporting medium, and the device is integrated in an exchangeable manner in the textile machine.

It has surprisingly been shown that when using the transport media proposed according to present invention they are distinguished by a high degree of insensitivity to disruption, flexibility and simple operation compared to the transport media known from the prior art. The variable integration of the device for transmitting data to a control device of the textile machine producing cross-wound bobbins allows the flexible use of the most varied transport media. If necessary, the transport medium together with the device can be transported to another textile machine and integrated there. The exchangeability both of the device and the transport media between the textile machines therefore allows the use of only a single device within a textile machine grouping. It is also achieved by means of the integration of the device that the device can be coupled to the power supply of the textile machine. In addition, the transport media provided according to the invention to transmit data are robuster and substantially more economical than notebooks according to the prior art. This equally applies in comparison with the structure and the maintenance or upkeep of the network infrastructure according to the prior art. In addition, the transport media according to the invention are more flexible to use as, for example, data can be transmitted directly from a textile machine newly received in the textile machine park to one of the transport media provided according to the invention without the textile machine firstly having to be physically connected to the network infrastructure and the network having to be logically integrated. Thus, data can be easily read from the respective textile machine and transported to the central control mechanism to input them there again so these data are accessible, for example for evaluation. Conversely, process data can be transmitted via the central control mechanism to the transport medium and then distributed to the textile machines.

Advantageously, by connecting the transport medium and/or the device, a process for updating the data stored in a control device of the textile machine can be initiated. The updating may be initiated, for example, by the PDA or the mobile telephone. In a corresponding manner, this process can also be achieved by the connection of a device which is set up to transmit data from other transport media according to the invention, in that by the reading in of the transport medium, an automated process for updating is initiated.

In this case, the textile machine may have a receiver into which the device can be introduced in an exchangeable manner for connection to the textile machine and in the process can be connected to the textile machine. In this manner, the device is immediately ready for operation and does not need any additional connection configuration.

In particular, the data transmitted to the transport medium may have a uniform data format. In this manner, the data stored on the transport medium may be transmitted both to textile machines with a corresponding device and other mechanisms which have a device corresponding to the transport medium type. This achieves a general compatibility which allows additional software necessary for the visualisation of the data stored on the transport media to be dispensed with. The uniform data format may preferably in the simplest case be the so-called ASCII format. Preferably, a data format should be used which allows a correspondingly prepared and formatted display of the data to be transmitted and can be read by current software applications.

In this case, the device may be connected via a communication interface to the textile machine. This simplifies the carrying both of the device suitable for transmitting data to the transport medium and also the transport medium itself in order to be able to connect the device in a factory hall, in which a large number of textile machines can be arranged, to the individual textile machines in order to store data from the textile machines on the transport medium or to transmit them to the textile machine.

For this purpose, a universal serial bus interface (USB interface) may be used as the communication interface. Communication interfaces of this type allow flexible connection of the device to the textile machine without a power supply being required on site. The device may be connected at any time to the textile machine via the USB interface without a complex configuration being necessary. In addition, the USB interface allows a very high data transmission rate to the transport medium.

Alternatively or in addition, an infrared interface (IR interface) can be used as the communication interface. Infrared interfaces are economical and above all allow communication with the mobile telephone or the palm-top computer such as the Personal Digital Assistant (PDA), an additional current supply not being necessary here either. The communication between the textile machine and the mobile telephone or the PDA is also based on a standardised data transmission protocol.

Furthermore, an interface device compliant with "Bluetooth®" wireless communications standards can be used as the communication interface. This interface also has a high degree of flexibility with regard to the connectability of the respective devices for transmitting data to the transport media. The aforementioned types of communication interfaces all have in common the advantage that no configuration outlay arises to produce communication between the device suitable for transmitting the data to the transport medium and the textile machine.

A tape drive may preferably be used as the device. Alternatively, a CD drive, a DVD drive, an MO disc drive, a minidisc drive or a memory card reading apparatus may be used as the device. Furthermore, a removable frame to receive a hard disc may be used as the device. Furthermore, external hard disc housing for receiving a hard disc can be used as the device.

The transport media which can be used in these devices have a high storage density, in other words, the ratio of the size of the transport medium to the data volume which can be recorded by this transport medium is very high.

In particular MO discs have higher physical data security than MDs, CDs or DVDs, as the MO discs are insensitive to high temperatures and magnetic fields. In particular, the temperature insensitivity at high temperatures allows use in countries with a tropical or sub-tropical climate. So-called digital memory cards have a considerably higher memory density compared to these very advantageous transport media. The memory cards are distinguished in particular by their small dimensions and their insensitivity of the surfaces in contrast to CDs and DVDs.

The configuration of the devices as a tape drive, CD drive, DVD drive, minidisc drives, MO disc drives or card reading apparatuses for digital memory cards with the associated transport media, in a simple manner, allows their archiving, their duplication and processing of the data stored on the transport media by means of apparatuses, which also have a corresponding device. Computers, above all, should be mentioned here, which in general, have devices of this type and are configured with the corresponding software to process the data contained on the transport media.

BRIEF DESCRIPTION OF THE DRAWING

The view in FIG. 1 shows an embodiment of a textile machine 1 in a schematic partial view with a device integrated into the textile machine for transmitting data from or onto one of the transport media according to the invention.

DETAILED DESCRIPTION OF THE PREFERRED EMBODIMENTS

Figure 1:
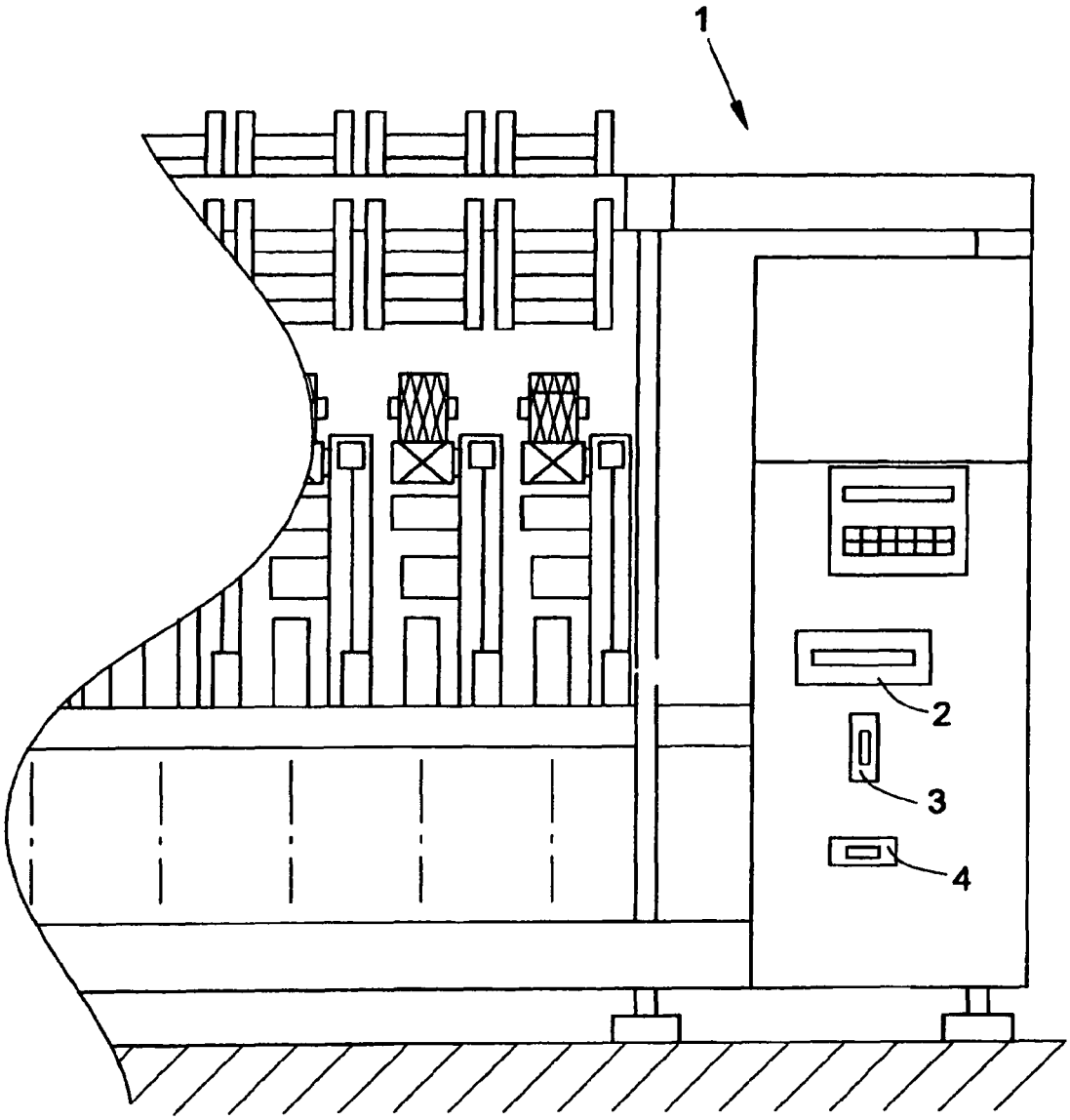

As the device for data transmission, in the present embodiment, a CD drive 2 or a DVD drive 2 is integrated into the textile machine in an exchangeable manner. A receiver is provided for this purpose, into which the device is introduced for connection to the textile machine. As an alternative, a tape drive or a removable frame for an external hard disc may be integrated into the textile machine.

Furthermore, communication interfaces are provided on the textile machine, via which one of said devices can be connected to the textile machine to transmit data from or onto the transport medium. The communication interface is designed as an infrared interface 3 and as a USB interface 4 (Universal Serial Bus). Those allow temporary connection of one of the aforementioned devices such as an external hard disc, an external CD drive, DVD drive, minidisc drive or magneto-optical disc drive, memory card reading apparatus, an external tape drive or a streamer or a zip drive to the textile machine without a large outlay for configuration. The communication interface may also be configured as an interface device compliant with "Bluetooth®" wireless communications standards.

These devices are arranged cumulatively in the present embodiment; for example the arrangement only of a CD drive 2 or DVD drive 2 or only an infrared interface 3 may also be provided, for example, as well as another combination of one or more of said devices and/or communication interfaces which allow the transmission to one of more of the transport media according to the invention.

The transport medium is designed according to the invention as a memory in a mobile telephone or a palm-top computer (Personal Digital Assistant), as a hard disc, as a magnetic tape, as a compact disc (CD), as a Digital Versatile Disc (DVD), as a minidisc (MD), as a magneto-optical disc (MO disc) or as a digital memory card. These transport media are either readable and writable by the devices integrated into the textile machine or are appropriately connected via the communication interfaces corresponding to the respective device with the textile machine 1 in such a way that a transmission of data based on a standardised data format takes place from or to the transport medium.

What is claimed is:

1. Method for the bidirectional transmission of data between multiple textile machines (1) producing cross-wound bobbins or between one or more textile machines (1) producing cross-wound bobbins and one or more same-level and/or higher level control systems with a device (2) for transmitting data to a transport medium, which is used for the transporting of data located on the transport medium, the transport medium being in operative connection with the textile machine (1) producing cross-wound bobbins to transmit data via the device (2), characterised in that a memory provided in a mobile telephone or a palm-top computer (personal digital assistant), a hard disc, a magnetic tape, a writable compact disc (CD), a writable digital versatile disc (DVD), a magneto-optical disc (MO disc), a minidisc (MD) or a digital memory card is used as the transporting medium and in that the device (2) is integrated in an exchangeable manner in the textile machine (1) wherein a process for updating the data stored in a control device of the textile machine (1) is initiated automatically by the connection of the transport medium and/or the device (2).

2. Method according to claim 1, characterised in that the data transmitted to the transport medium have a standardised data format.

3. Method according to claim 1, characterised in that the device (2) is connected to the textile machine (1) via a communication interface (3, 4).

4. Method according to claim 3, characterised in that a USB interface (4) is used as the communication interface.

5. Method according to claim 3, characterised in that an infrared interface (3) is used as the communication interface.

6. Method according to claim 3, characterised in that an interface device compliant with "Bluetooth®" wireless communications standards is used as the communication interface.

7. Method according to claim 1, characterised in that a tape drive (2) is used as the device.

8. Method according to claim 1, characterised in that a CD-drive (2) is used as the device.

9. Method according to claim 1, characterised in that a DVD-drive (2) is used as the device.

10. Method according to claim 1, characterised in that a minidisc drive is used as the device (2).

11. Method according to claim 1, characterised in that an MO disc drive is used as the device (2).

12. Method according to claim 1, characterised in that a removable frame for receiving a hard disc is used as the device (2).

13. Method according to claim 1, characterised in that external hard disc housing for receiving a hard disc is used as the device (2).

14. Method according to claim 1, characterised in that a card reading apparatus is used as the device (2).

* * * * *